US006877277B2

(12) United States Patent
Kussel et al.

(10) Patent No.: US 6,877,277 B2
(45) Date of Patent: Apr. 12, 2005

(54) COUPLING FOR EXPLOSION-PROOF CONNECTION OF TWO ELECTRIC LINE ENDS

(75) Inventors: Willi Kussel, Werne (DE); Frank Reiner, Gevelsberg (DE)

(73) Assignee: Tiefenbach Bergbautechnik GmbH, Essen (DE)

( * ) Notice: Subject to any disclaimer, the term of this patent is extended or adjusted under 35 U.S.C. 154(b) by 0 days.

(21) Appl. No.: 10/450,003

(22) PCT Filed: Dec. 8, 2001

(86) PCT No.: PCT/EP01/14436

§ 371 (c)(1),
(2), (4) Date: Jun. 9, 2003

(87) PCT Pub. No.: WO02/47213

PCT Pub. Date: Jun. 13, 2002

(65) Prior Publication Data

US 2004/0033710 A1 Feb. 19, 2004

(30) Foreign Application Priority Data

Dec. 10, 2000 (DE) ..... 100 61 446

(51) Int. Cl.[7] ..... H01R 13/213
(52) U.S. Cl. ..... 49/314; 439/752; 439/598
(58) Field of Search ..... 439/751, 454, 439/462, 587, 584, 274, 275, 752, 701, 598, 314, 310–311, 733.1, 318

(56) References Cited

U.S. PATENT DOCUMENTS

| | | | | |
|---|---|---|---|---|
| 1,995,195 A | | 3/1935 | Tomblom | |
| 3,455,580 A | * | 7/1969 | Howard | 439/318 |
| 3,576,517 A | * | 4/1971 | Johnson et al. | 439/274 |
| 4,795,360 A | | 1/1989 | Newman et al. | |
| 4,988,316 A | * | 1/1991 | Roy | 439/752 |
| 5,104,340 A | | 4/1992 | Elam et al. | |
| 6,180,882 B1 | * | 1/2001 | Dinh | 439/462 |

FOREIGN PATENT DOCUMENTS

| | | |
|---|---|---|
| GB | 529219 | 11/1940 |
| GB | 684271 | 12/1952 |

* cited by examiner

*Primary Examiner*—P. Austin Bradley
*Assistant Examiner*—Felix O. Figueroa
(74) *Attorney, Agent, or Firm*—Alston & Bird LLP

(57) ABSTRACT

For an explosion-proof connection of two electric line ends (25, 26), the contact elements (27, 28) are accommodated in two tubes (1, 2), which can be joined in an explosion-proof manner. Each of the plug-in contact parts is axially secured in its tube by a radial projection (41) in the direction toward the end facing the other tube. At its line end, each of the tubes is closed by an end cap (42), which sealingly surrounds with a narrow outlet (44) the electric lines, including an insulation (43). The tube, in which the plug-in contact part with the contact pins is axially secured, extends beyond the tip of the contact pins, and has there an enlarged diameter, with which it surrounds the other tube (inner tube 1,3) with a narrow cylindrical gap (sealing gap 20).

17 Claims, 7 Drawing Sheets

COUPLING FOR EXPLOSION-PROOF CONNECTION OF TWO ELECTRIC LINE ENDS

BACKGROUND OF THE INVENTION

The present invention relates to a coupling for an explosion-proof connection of two electric line ends with the coupling including tubes for being coupled to one another in an explosion-proof manner, the line ends being respectively accommodated in and permanently connected to the tubes, each of the line ends including a plug-in contact part with contact elements, the contact elements including a contact pin of one of the line ends and a contact socket of another of the line ends, the contact pin being pluggable into the contact socket to provide a conductive connection between the contact elements, and the contact elements being positioned so that the conductive connection exists while the tubes are coupled to one another in the explosion-proof manner.

Couplings of the type described above are generally known. A problem exists with a coupling of the type described above in that it is very large and heavy with all its necessary functional elements, so that it is unsuitable for a mobile operation, in particular for connecting hand-held devices. Especially heavy and space-consuming are the means for a reliable, in particular protected accommodation of the contact elements, for a protection against explosion, for securing the coupling halves and lines both in the axial and in the radial direction, and for joining the two coupling halves in a secure and yet operationally reliable manner. It is to be ensured that the tube ends are in alignment with each other. Furthermore, the risk is incurred that the tube ends rotate relative to each other in the circumferential direction as a result of vibrations, or in any other fashion, so that the electrical connection disengages unintentionally.

BRIEF SUMMARY OF THE SOME ASPECTS OF THE PRESENT INVENTION

It is an object of the present invention to equip a coupling such that the two tube ends can be joined with each other by an easy rotational motion, without incurring the risk of disengagement, that despite the smooth operation, the alignment of the two tube ends adjusts automatically, and that the coupling can be constructed small, while complying with all safety requirements and operational ease. This and other objects of the present invention are provided in accordance with one aspect of the present invention by a coupling for providing an explosion-proof connection between electric line ends, with the coupling including tubes for being coupled to one another in an explosion-proof manner. The line ends are respectively accommodated in and permanently connected to the tubes, and each of the line ends includes a plug-in contact part with contact elements. The contact elements include a contact pin of one of the line ends and a contact socket of another of the line ends. The contact pin is for being plugged into the contact socket to provide a conductive connection between the contact elements. The contact elements are arranged so that the conductive connection exists while the tubes are coupled to one another in the explosion-proof manner. For each of the plug-in contact parts, the plug-in contact part includes a radial projection which functions as a stop that cooperates with a corresponding projection in the tube in which the plug-in contact part is accommodated. These projections axially secure the plug-in contact part in the respective tube to restrict movement of the plug-in contact part in a forward direction which extends from the plug-in contact part toward the other plug-in contact part while the tubes are coupled to one another in the explosion-proof manner. For each of the tubes, the tube's end into which the respective line ends enter the tube is closed by an insulating end cap, which sealingly surrounds the electric lines that enter the tube.

The outer tube, in which the respective plug-in contact part with contact pins is axially secured, projects beyond tips of the contact pins secured within the outer tube and includes an enlarged inside diameter that surrounds the inner tube with a narrow cylindrical gap that is sealed. In the assembled state, for each of the tubes, a hollow space between the plug-in contact part within the tube and the end cap that closes the tube contains a stop packing. The stop packing is supported in the region of the end cap and presses the plug-in contact part that is within the tube in the forward direction.

In this connection, an advantage results from a very simple construction in the following respects: it is possible to construct plug-in contact parts for the contact pins and contact sockets from identical parts. The measures, which are necessary for making the coupling explosion-proof in accordance with regulations, are simultaneously used as construction elements with the aim of simplifying construction and assembly.

The tube with all functional elements, including the connection element to the other tube and the reliable supply of the electric lines, comprises not only a housing of a simple, explosion-free construction, but also construction elements for an electrically suitable and safe assembly and retention of the contact elements.

The accommodation of the contact pins and contact sockets in the cylindrical plastic drums, and the accommodation of the cylindrical plastic drums in the tubes can be effortlessly carried out without tools.

The design permits a very compact construction.

A very simple and electrically accident-free mounting of the lines in the tubes of the coupling can result from the stop packing being a thermosetting, electrically nonconducting synthetic resin, namely plastic, that encapsulates the hollow space between the plug-in contact part and the end cap. Also, the stop packing can be an elastic ring, which is supported in the region of the end cap. This elastic ring provides a simple and electrically accident-free mounting of the lines in the tubes, which will be especially suitable when the coupling is to be used as a user-mountable replacement part.

The drums and contact elements can be made substantially identical as regards the means for a radial and an axial retention.

Snap rings can be used both as an assembly element for preliminarily securing the contact elements and as a functional element for applying the necessary axial force to the plug-in contact parts.

Special attention can be directed to the connection element for the tubes of the two coupling halves, to enable a fast engagement and disengagement of the coupling without tools.

A bayonet joint can be used to cause the tube ends to abut each other with a sealing force, as is the case with explosion-proof couplings. The bayonet joint can include radially outward directed projections carried by the inner tube, radially inward directed projections carried by the outer tube, and a track of the outer tube that is for simultaneously being in receipt of the outward directed projections and allowing relative movement between the outward directed projections and the inward directed projections. This movement can be between an engaging position and an inserting position. The engaging position is characterized by the outward directed projections and the inward directed projections respectively interacting with one another in a manner that restricts the inner tube from being withdrawn from the outer tube, with the outward directed projections and the inward directed projections being in the engaging position while the tubes are coupled to one another in the explosion-proof manner. The inserting position is characterized by the outward directed projections and the inward directed projections not being arranged with respect to one another in the manner that restricts the inner tube from being withdrawn from the outer tube.

The bayonet ring with its projections must be rotated with a small amount of force relative to the other bayonet ring as far as its engaging position.

There, an elastic body within a groove evades into an adjacent hollow space(s). Since the hollow spaces on the one hand and the projections on the other hand have the same gauge, and since they are preferably arranged in the corners of an equilateral triangle, rectangle, or higher polygon, the elastic resetting force, which the elastic body, flexible tongue, or ring exerts in the radial direction, is used for centering.

The elastic body may have, for example, the shape of a flexible tongue. Such a flexible tongue is mounted preferably in a flat pocket, and preferably unilaterally on the side facing away from the track between the inserting position and the engaging position, so that it bridges the hollow space, i.e., it does not lie against the groove bottom. A flexible tongue of this type may comprise in addition a notch or the like, which the head of the projection engages as it enters its position of engagement. As a result of elastically pressing thereinto the flexible tongue, a centering is obtained, and likewise an additional retention in the circumferential direction by the entry of each projection into an engagement notch.

Likewise, it is possible to make the groove bottom circular-cylindrical, on or in which the projections move between their inserting position and their engaging position. However, the groove bottom can also have a radial recess for providing adequate space for the evasive movement of the flexible tongue.

A very simple construction will result when the elastic body is an elastic ring, a rubber ring, helical spring ring, O-ring, or the like. In this case, the groove bottom, in which the projections move between their inserting and their engaging position, is made circular-cylindrical or in such a manner that a radially narrowest point results directly before the engaging position. In the position of engagement, the groove bottom forms a radial recess, over which the elastic ring extends, and into which the elastic ring evades in the radial direction.

The configuration of the groove bottom or the configuration of the recess in the engagement position determines as regards length, width, and radial depth of the resulting hollow space, the type and extent of the radial centering and the axial retention of the two tube ends. In particular, the groove bottom or recess can somewhat deviate in the axial direction from the radial plane of the remaining groove bottom in the direction toward the other bayonet ring. As a result, the elastic body moving into the hollow space also causes an axial force, which can be used for purposes of sealing the two tube ends.

The radial projections of the inner ring can be corners of a disk arranged on the bayonet rings in face. This can be simple from the manufacturing viewpoint, and allows an exact centering. In this instance, a regular polygonal disk will be selected with more than three sides, when the corners have only a small difference in diameter in comparison with the height of the sides.

For purposes of safely reaching the engaging position in the case of the proposed construction of the bayonet joint, without however exceeding it unintentionally, the engaging position can be unilaterally defined by a stop.

A circumferential bead arranged on the end cap can be used for axially securing the line in its coupling half in a reliable, but space-saving manner.

BRIEF DESCRIPTION OF THE DRAWINGS

Reference will now be made to the accompanying drawings, wherein.

DETAILED DESCRIPTION OF THE INVENTION

The following description applies to all embodiments and drawings, unless express reference is made to particularities and differences.

The illustrated tube ends are protective tubes for electric cabling. The tube ends accommodate plug-in connections, which create the electric contact of a user with a source of voltage by engaging the tube connections. Insofar, they may be in particular tube couplings, which ensure an explosion-proof, electric connection and are suitable for underground mining.

Description of the Coupling

Figure 1:
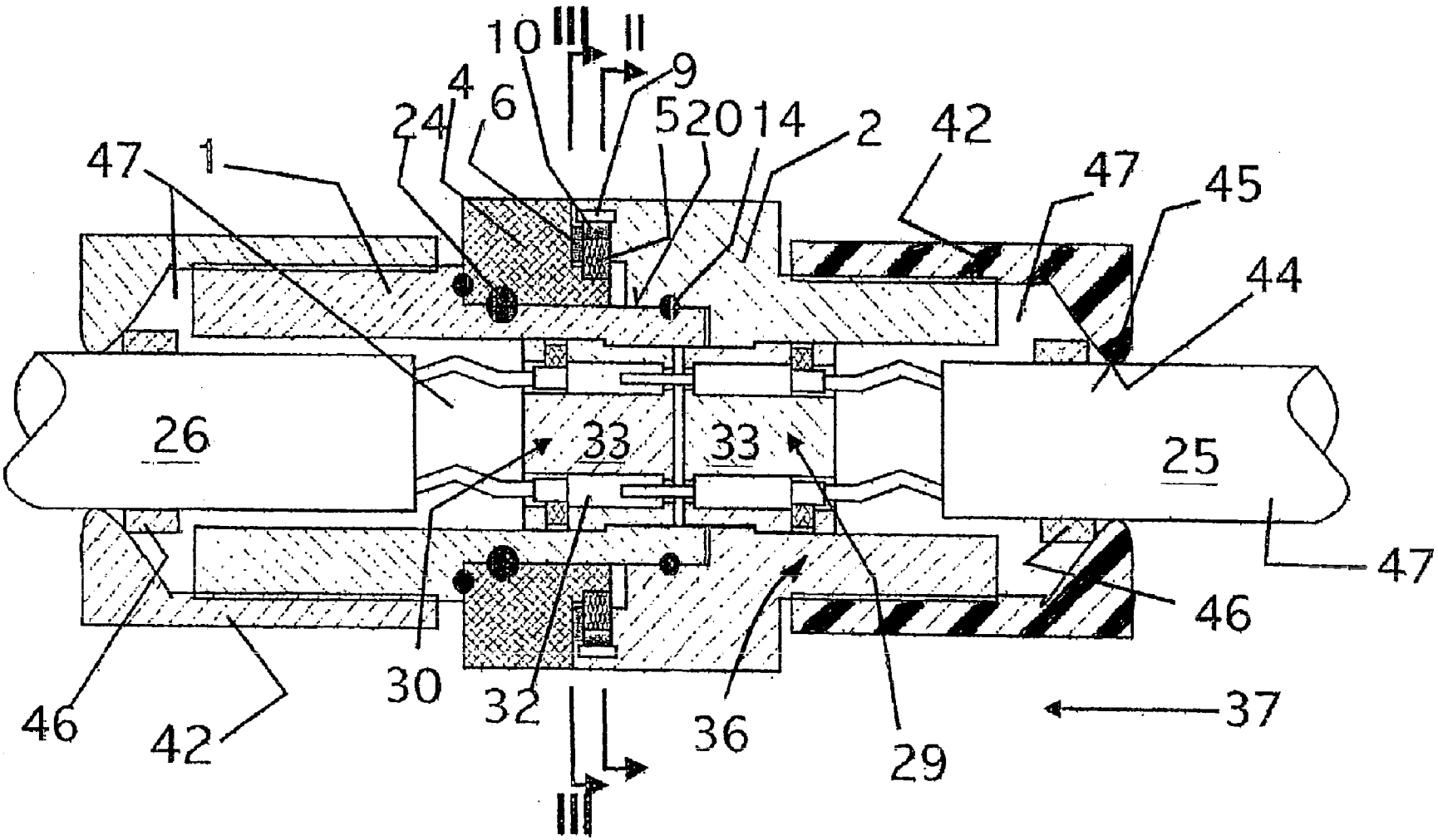
FIG. 1 is an axial sectional view of an electric line coupling.
Figure 10:
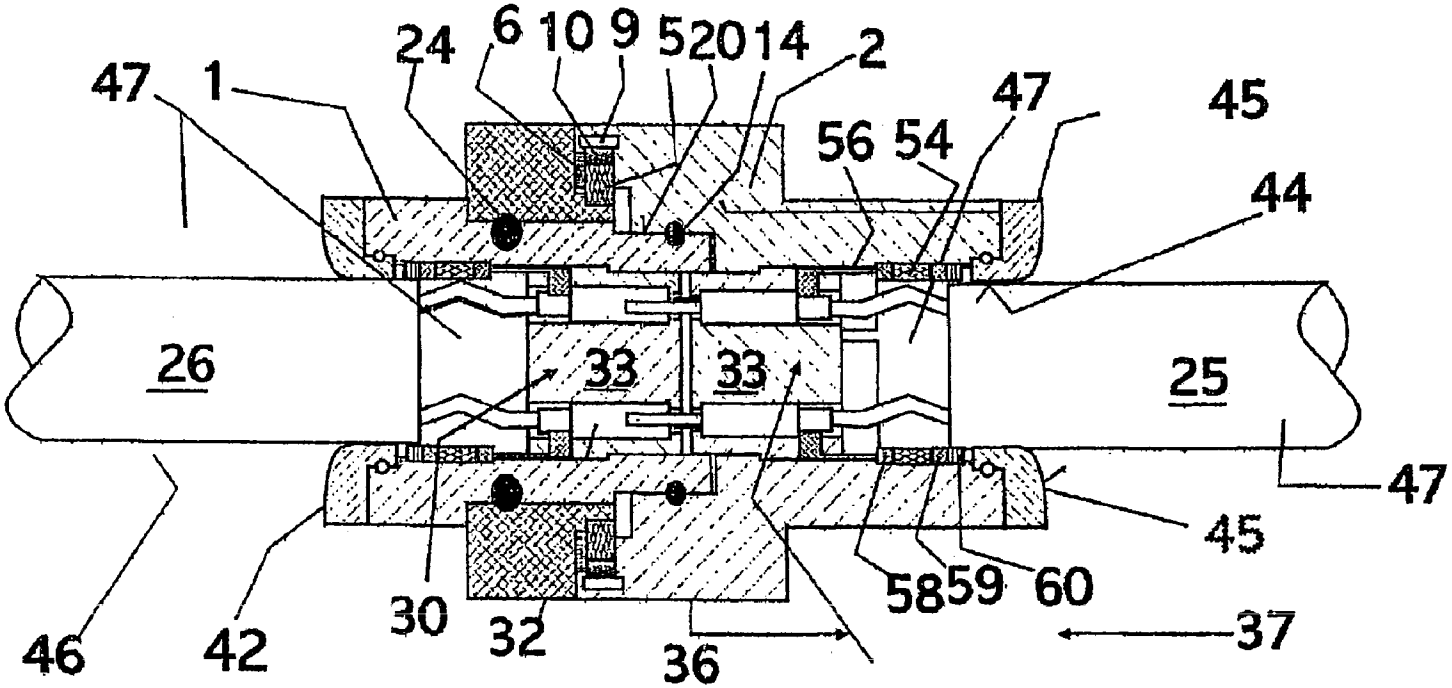
FIG. 10 is an axially sectioned view of a further embodiment of the electric line coupling.

The coupling of FIGS. 1 and 10 consists of a cylindrical inner tube 1 and an outer tube 2. The outer tube is adapted to the inner tube with a narrow gap 20 therebetween. The cylindrical gap 20 is sealed by an O-ring 14. Due to its length and narrowness, however, the seal is also explosion-proof in line with regulations. Both tubes 1 and 2 are interconnected in a dustproof and fluid-tight manner by means of a bayonet joint 3, 4, which will be described further below.

End pieces or end caps 42 are slipped over, or screwed, into the free ends of tubes 1 and 2. The end pieces 42 surround the cable with an insulating sheath 43, at their other end with a narrow outlet 44 and a bending bead 45.

In the one tube (inner tube 2), a plug-in contact part 29 is accommodated for receiving a contact pin 31. The other, outer tube 1 accommodates plug-in contact parts 30 for receiving contact sockets 32. The plug-in parts 29 and 30 are made substantially identical. They are cylindrical bodies of plastic (drums 33), which have on their outer circumference a shoulder of a larger diameter (diametrical step, projection 41). With their smaller diameter portion, the drums can be slid into the tubular interior of inner tube 1 or outer tube 2. The interior of the inner tube and the outer tube has the same kind of diametrical step, against which the drum comes to lie with its enlarged diameter portion.

The drums possess axis-parallel bores (axial bores) 34, into which the contact elements, i.e. on the one hand contact pins 31 and on the other hand contact sockets 32, are fitted with a slight play and pushed thereinto from the rear side of the drums (i.e., the connection side). On the front side (i.e., contact side), each axial bore includes a necking 38, which secures the contact element in the axial direction, but leaves a free passageway for the front narrowed end, i.e, plug-in end 37, of the contact pins. This also applies to the drum, into which the contact sockets are inserted.

Furthermore, each contact socket or each contact pin has a necking 49 at the end facing away from the contact side, i.e., connection side 36. This necking corresponds in its axial position to a circumferential groove 39, which is provided in the region of connection side 36 on the circumference of the drum, and which extends as far as the cross section of the axial bore for the contact elements. Into this circumferential groove, a snap ring 40 is inserted, which engages behind the contact elements at diametrical step 49, and secures the contact pins or contact sockets (provisionally) in the axial direction, until they are finally locked in position, for example, by encapsulating. The kind of locking will be described in greater detail further below.

Figure 6:
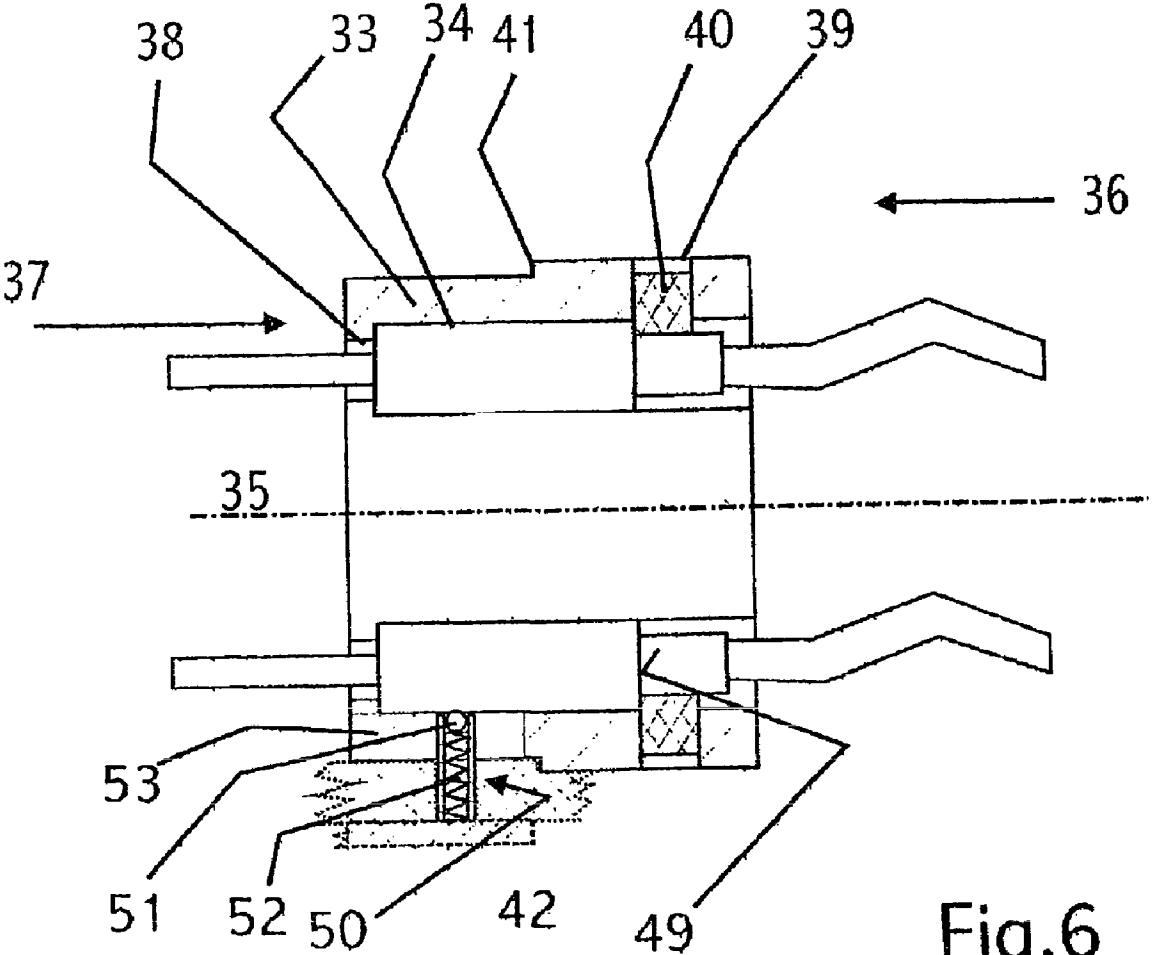
FIG. 6 shows an embodiment of a plug-in contact part.
Figure 9:
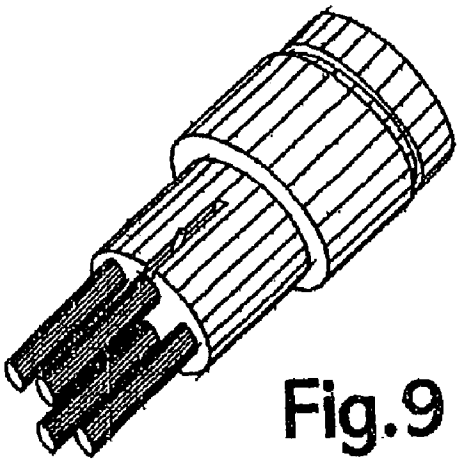
FIG. 9 is a perspective view of a further plug-in contact part.
Figure 8:
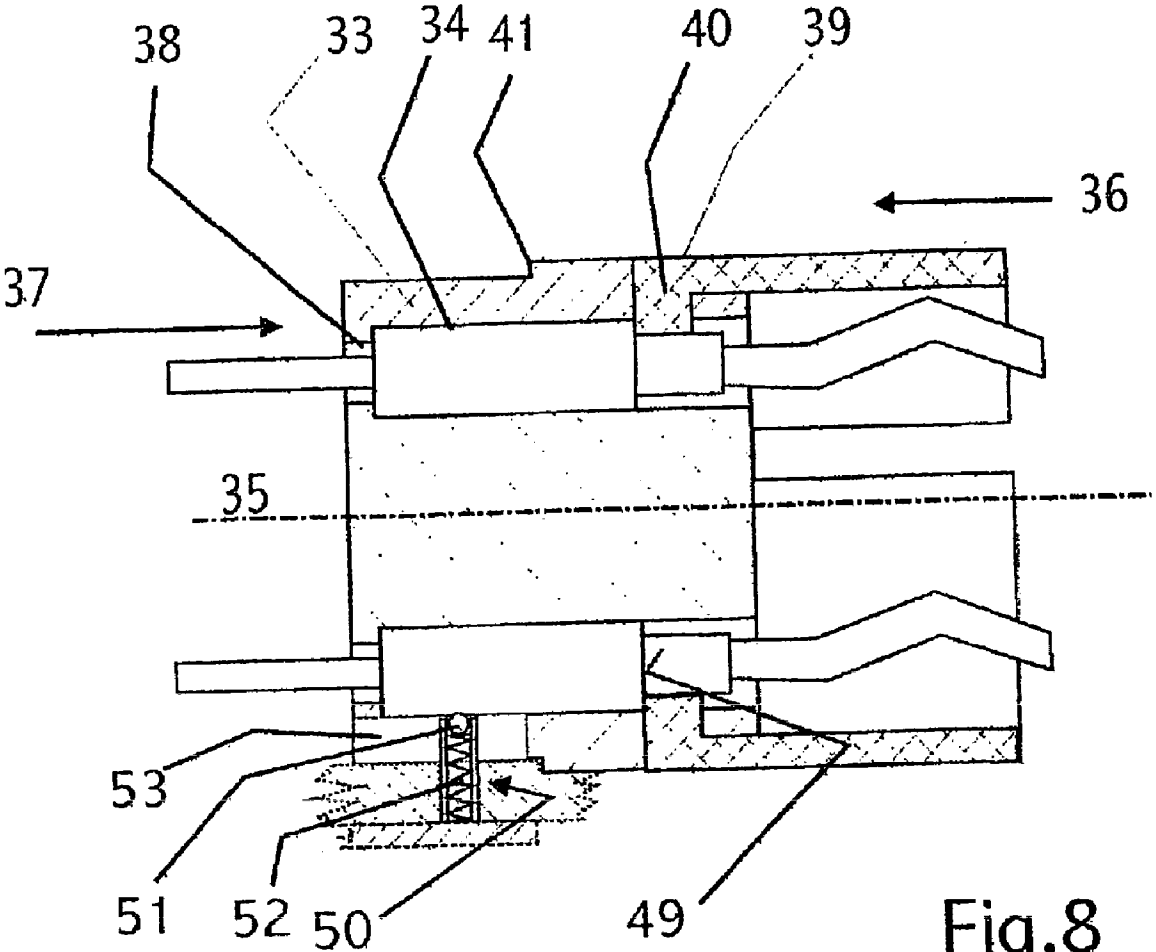
FIG. 8 is a further embodiment of a plug-in contact part.

The contact elements also include a pairing of grounding pin and grounding socket. Same are connected to the respective tube by a radial connection element. In particular, the connection element may be a spring-supported threaded pin or a radial pin that is to be driven into a bore, or (as shown in detail in FIG. 6) a pairing 50 of a ball 51 biased by a spring 52. These connection elements are permanently secured to the inside wall of tube 1 or 2, and they project radially inward. On the outside of the tube, the bores, into which the connection elements are inserted, are covered in the fully assembled state by end caps 42, which are slipped over the tube, or by other annular components, in particular a bayonet ring, so that the connection elements do not fall out, or can be removed otherwise. For an easy assembly, each drum possesses on its circumference a longitudinal groove, i.e., radial slot 53, which slits the axial bore for the grounding contact pin or grounding contact socket toward the outside. This permits mounting the connection element in the tube already before the assembly of the drum, and subsequently assembling and disassembling the drum with the installed contact elements. The radial slot also ensures that the drum can be assembled only in the rotational position in which the grounding contact element makes contact with the tube via the connection element.

After welding or clamping the wires to the ends facing away from the contact side (line ends 25, 26) of the contact pins or contact socket, a circumferential bead 46 is formed on the insulating sheath 43 of the cable end and permanently secured thereto. Advantageously, this can occur, for example, in that a cable tie is stretched over the insulating sheath in such a manner that the cable tie digs itself into the insulating material. Such cable ties are plastic or metal bands, which are provided at one end with an engagement head with a narrow opening and at the other end with one-way notches. This end is pulled through the engagement head without being able to return.

After inserting and screwing on the end parts 4 and 5, the latter form with the inner tube or outer tube a hollow space, which accommodates the drums, and into which the ends of the contact sockets or contact pins extend, which face away from the contact side. This hollow space is encapsulated, with the plastic also entering the axial bores of the drums.

The thus-resulting coupling halves are pushed into each other. In so doing, the outer tube is slipped over the inner tube, and a gasket 14 is used to seal a long gap 20 that forms between the outer circumference of inner tube 2 and the inner circumference of outer tube 1. The one half (bayonet ring 4) of bayonet joint 3 is placed on the inner tube, for example by means of a snap ring or retaining ring 24, which is inserted into a circumferential groove of the inner tube. This bayonet ring 4 is therefore supported for rotation about the inner tube, but locked in position in the axial direction. With its end face, which faces away from the other coupling half, this half 3 of the bayonet joint in the form of a ring is pressed against a gasket 21 and a shoulder of the inner tube for preventing moisture and dirt from entering. On the coupling side, it is also possible to seal the bayonet ring 4 by an inserted gasket against the end face of the outer tube. The bayonet ring 4 has a shoulder in the form of a circular cylinder, which is also adapted, as regards its inside diameter, to the outside diameter of the inner tube. At its free end, this shoulder includes radially outward extending projections, which are evenly distributed over the circumference. To this end, for example, the end face may have the shape of a polygon, for example, a hexagon, whose smaller outside diameter (height between two opposite sides) is at any rate greater than the outside diameter of the annular shoulder. Thus, a groove shaped recess extends between the bayonet projections and the ring.

At its open ends, the outer tube has a shape, which is adapted to the bayonet ring with the bayonet-type projections. Behind this opening cross section, a groove is cut, whose diameter is at any rate greater than the largest diameter between two opposite bayonet-type projections. In the region between two bayonet-type projections, this groove comprises cutouts, recesses or other deviations from a circular cylindrical shape. An O-ring is inserted into this groove. The dimensioning of the guide groove for the O-ring and of the O-ring on the one hand, as well as of the bayonet-type projections on the other hand is such that the bayonet-type projections radially displace the O-ring outward or compress it, when the two halves of the bayonet joint are pushed together. When the bayonet ring 4 of the bayonet joint is now rotated, the bayonet-type projections will press the O-ring into the recesses. As a result, the bayonet ring is radially secured relative to the other tube. Preferably, a retention also occurs in the circumferential direction. To this end, the bayonet ring includes axis-parallel stop pins, which extend over the above-mentioned groove in the region between two bayonet-type projections. In the direction of rotation, these stop pins are located behind one or more of the radial projections, but in the vicinity of the respective projection, so that the pins do not interfere, when the bayonet ring 4 is inserted into the counterpart. During the rotation of bayonet ring 4, the pins are also able to move in the circumferential direction in the region of the bayonet-type recesses. However, as the rotation continues, the pins will abut before the region between two recesses. By nature, this region is used for locking the bayonet-type projections, and therefore has a smaller diameter. As a result, the rotational movement of the bayonet ring 4 relative to the counterpart is restricted in the circumferential direction.

On its front side facing the counterpart, the bayonet ring 4 includes a recess, into which an O-ring is inserted as a seal. Thus, by locking the bayonet joint, a seal against dust and moisture is also provided in this place. Further details with respect to the configuration of the bayonet joint of the two coupling halves become apparent from the following description with reference to FIGS. 2–5.

This type of coupling connection for electric lines is normally supplied by the manufacturer. However, it is also required that the coupling joint be available as a user-mountable spare part. In this instance, it is not possible to seal the contact pins and contact sockets, as well as the wire connections.

Figure 11:
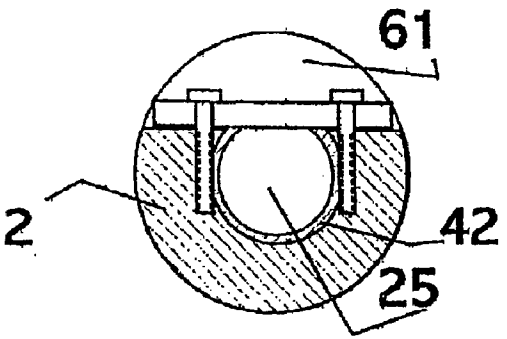
FIG. 11 shows a line clamp.

A suitable realization is shown in FIGS. 10 and 11, to which the foregoing description applies. Deviations therefrom are described in the following:

The drums and the contact pins inserted therein are secured in the coupling half by a mountable stop packing. This stop packing comprises primarily a rubber-elastic spacer sleeve 54. The spacer sleeve is compressed by means of a screw, namely ring bolt 60 that can be screwed into the housing end in such a manner that the contact pins or contact sockets are secured in their holders. Subsequently, an end cap 42 is slipped over the housing end or inserted therein. In the end part, the cable is secured by clamping. To this end, a clamping plate is inserted into a groove, which cuts into the cable passageway. The screws for this clamping plate can also be used as an antirotation device for the screws that are adapted for insertion into the housing end.

Thus, the stop packing comprises an elastic ring 54, which supports itself on the one hand on the line end of the contact elements, and on the other hand on the end cap in the region thereof, or preferably on a support ring 55 that can be screwed into the end of the tube with an external screw thread. Between the contact elements and the elastic ring 54, the support connection is effected as follows:

On its outer circumference, the snap ring 40 comprises an axial extension, preferably a cylindrical extension 56 with a longitudinal slot 57 in one of its axial planes. The ring 55 supports itself on the free end thereof, which axially projects beyond the drum. With its outer circumference, this extension is fitted into the interior space of the tubes. As previously described, the support ring that forms the end face of the extension, engages behind the diametrical steps on the contact elements, in that it is inserted into the circumferential groove on the drum. To provide the elastic ring with an adequately large contact surface on its two front sides, a ring 58 or a ring 59 is placed in front of each of the end faces. A ring bolt 60, which is screwed into the end of tube 1 or 2, is used for applying the necessary axial force to the stop packing. As shown, it is also possible to use instead the end caps 42 for applying the axial force, since in this embodiment, the end caps 42 comprise an axial extension, which is inserted into the line end of tube 1 or 2. To secure the line, both the end of tubes 1,2 and the axial portion of end cap 42 of the present embodiment are provided with a bevel 61, the bottom of which extends in the cross section of the line. To the bottom of this bevel, a clamping plate 62 is mounted with two screws 63. As a result, the clamping plate clamps the line in the narrowest opening 44 of end cap 42. At the same time, the screws are used as an antirotation device, since the ends of the screw bores are located in the circumferential seam between the inside jacket of tube 1, 2 and the outside jacket of the axial extension of end cap 42.

FIGS. 2–5 illustrate the following:

The two tube ends 1 and 2 are interconnected by a bayonet joint. The bayonet joint comprises an outer ring 3 and a bayonet ring 4, which forms the inner ring. It can also be reversed.

Figure 2:
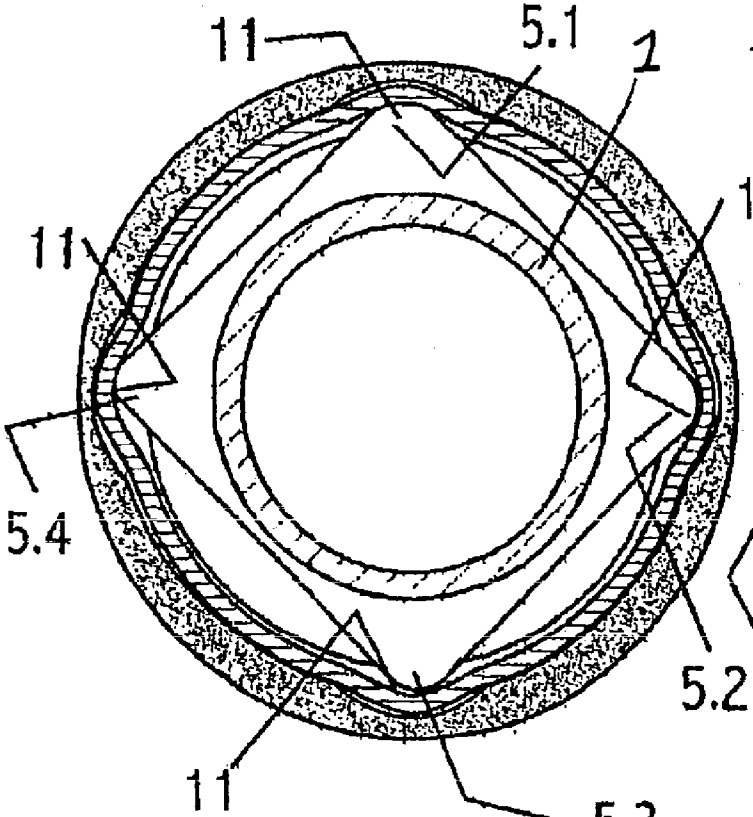
FIG. 2 is a radial sectional view of the embodiment of FIG. 1 taken along line II—II.

The inner ring 3 comprises radially outward directed projections in the direct vicinity of its end face. These projections are, for example, radial pins or disk-shaped tabs, which are permanently joined to the tube end 1 or its bayonet ring 3. In the embodiments of FIGS. 1, 10, and 2–4, the ring is a special section disk, which has in the embodiment the shape of a square. However, it may also be any polygon, preferably a triangle, square, or hexagon. For the selection, only constructional reasons are decisive. It is likewise possible to flatten the corners of the polygonal disks, as shown in the embodiment of FIG. 2. This results in projections 5.1, 5.2, 5.3 and 5.4, which are directed radially outward. A head 11 of these projections is circumscribed by a common external cylinder. This external cylinder has a diameter, which is adapted to the components of the outer ring 4, as will be described further below.

In the embodiment of FIGS. 1, 10, the outer ring is permanently connected to the tube end 2.

Figure 4A:
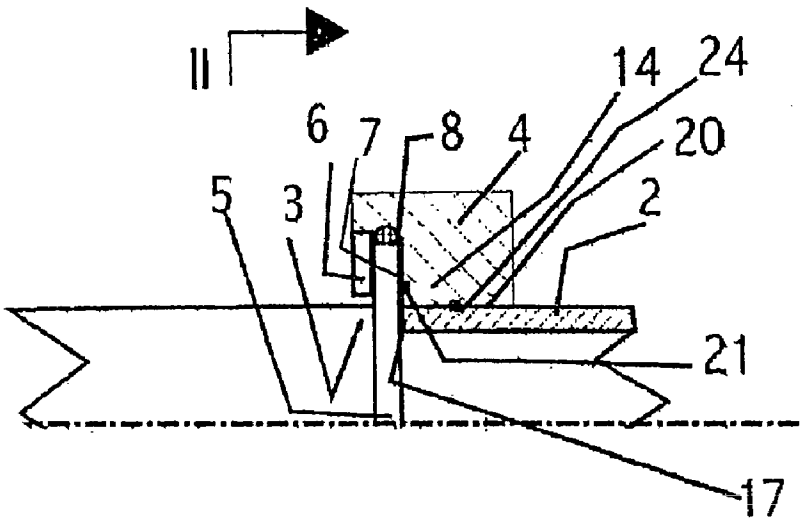
FIG. 4 shows an embodiment, wherein the outer ring is rotatable relative to the tube, but axially secured.
Figure 4:
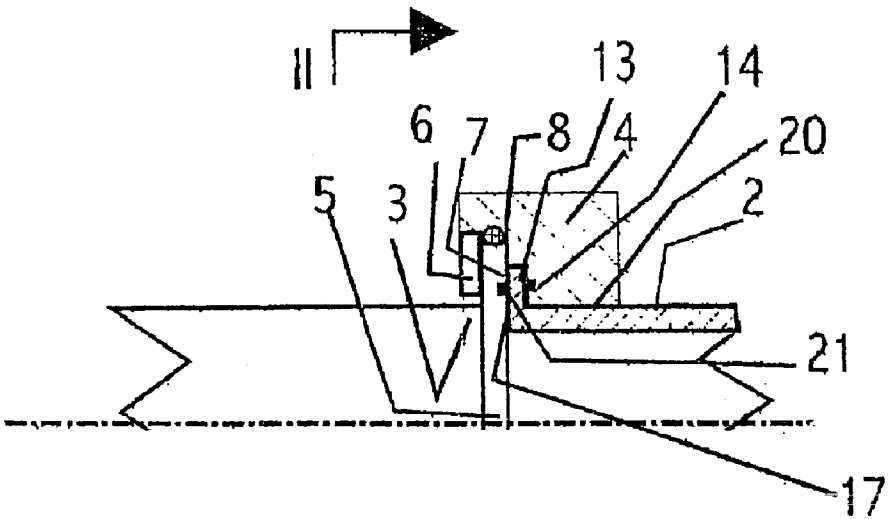

In the embodiment of FIG. 4, the outer ring is a separate, annular component. Same possesses a cylindrical, inner running surface 20, which is however adapted to the outside diameter of tube end 2 with a gap in such a manner that the outer ring can be rotated relative to the tube end 2.

In the embodiment of FIG. 4, the tube end 2 mounts a radially outward projecting stop ring 13, which axially secures the outer ring 4 in the locking direction of the bayonet joint. Between the end face of stop ring 13 and the facing end face of outer ring 4, a gasket 14 is arranged for sealing. Primarily, however, a gasket 21 is arranged between the end face 7 of stop ring 13 opposite to the other tube end and the facing end face of tube end 1 for sealing the seam between the two tube ends.

In the embodiment of FIG. 4A, the stop ring 13 is replaced with a retaining ring 24. Same is constructed as a snap ring and extends in the inner running surface between the tube end 2 and the bayonet ring, in grooves which are provided in both components and located in the same radial plane, thereby effecting an adequate axial retention of the bayonet ring in both directions.

The following description applies to all embodiments.

Figure 3:
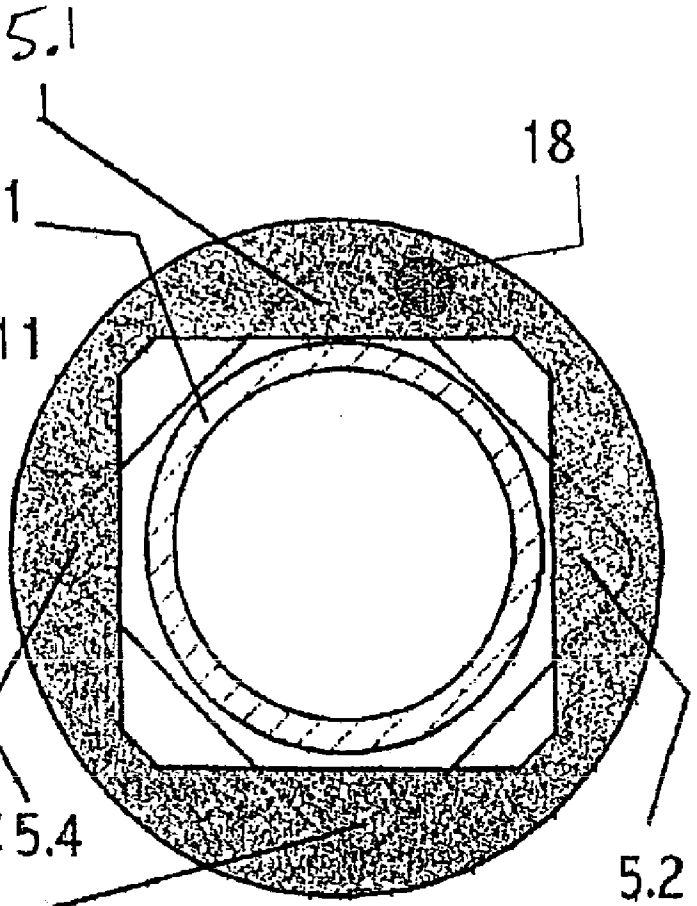
FIG. 3 is a top view of the outer ring 4 of the bayonet joint along line III—III of FIG. 1.

On its end face opposite to the other tube end, the outer ring 4 is provided with radial projections 6. These projections 6 are distributed over the inner circumference of outer ring 4 at the same gauge as the projections 5 of the inner ring. In the illustrated embodiment, the end face of outer ring 4 is therefore shown as a circular-cylindrical disk, which is best seen in FIG. 3. In the illustrated embodiment, this disk is opened by a polygon, for example, a square. The outer circumference of this square is adapted in its dimensions to the polygonal disk 5 of the inner ring, so that the polygonal disk 5 can extend through the square opening. In this case, the center regions of the sides of the square form projections 6.1, 6.2, 6.3, 6.4.

Furthermore, at least one of the bayonet rings comprises a radial shoulder, which extends in the circumferential direction, and which has a distance from the projections of this bayonet ring. This distance largely corresponds to the axial thickness of the projections of respectively the other bayonet ring, so that the shoulder with the projections of this bayonet ring forms a groove for the projections of the other bayonet ring, in which the projections of the other bayonet ring are able to move between their inserting position and their engaging position. In the embodiments, the polygonal disk 6 or the other projections 6.1, 6.2 et seq. form with the above-described end face 15 of outer ring 4, a groove 8 which is closely adapted in its axial extension to the axial thickness of the projections 5, i.e., to the polygonal disk 5. The outside, substantially cylindrical circumference of this groove 8 forms a track 16 for the projections of the other bayonet ring. The outside diameter of this track is somewhat larger than the diameter of the external cylinder, which encloses the heads 11 of the projections 5.1–5.4. However, it should be pointed out that while for the functioning of the bayonet joint an axially limited groove is advantageous for axially guiding the projections of the other bayonet ring, the bottom this groove need not also be at the same time the cylindrical guide track for these projections. Instead, the present invention may also be applied as an alternative or in addition in such a manner that the cylindrical circumference of the inner ring 3 forms the cylindrical track for the projections of the outer ring 4, which is bridged in the position of engagement by an elastic body.

In the embodiment of FIGS. 2–4, the groove 8 receives an elastic body in the form of an elastic ring, or rubber ring, in particular O-ring. The cross section of this ring has no significance for the invention. In particular, it can be a ring with a circular or elliptic cross section.

In the position of engagement, which will be described in greater detail below, the groove bottom 16 has a recess. This recess has a larger diameter than the remaining groove bottom. The extension of this recess in the circumferential direction is substantially adapted to the shape of head 11, with the thickness of the inserted ring having to be considered in addition.

As an alternative or in addition, the inner ring can also have such recesses. In the case of the inner ring, they may be bevels. In this case, the inner ring is also provided with a track having a groove bottom 16 with recesses, into which an elastic body, in particular in the form of an elastic ring, O-ring, or spring ring is inserted. In this instance, the heads 11 of polygonal disk 5 project beyond this groove bottom only in some places.

In the meaning of the present invention, a recess signifies a diameter increase with respect to the track on the outer ring, or a diameter decrease with respect to the track on the inner ring, which extends only over a limited circumferential range.

The diameter of the track 16 with the elastic body or ring inserted therein is closely adapted to the external cylinder of the projections. At any rate, the diameters are designed such the two bayonet rings can be inserted into each other with little effort, so that the projections enter track 8 in the axial direction.

It is also possible, in particular with the use of an elastic body with a great lateral yielding capacity that the projections exert a radial force on the elastic body already during the insertion and force it to yield laterally. In this case, the track can be made concentric with the external cylinder of the heads 11 of the projections, which move therein.

However, it is also possible that the diameter of the track between the inserting position and the engaging position changes in the course of the track in the direction toward the engaging position such that the freedom at the top of heads 11 becomes smaller, and that an increasing radial force is exerted on the elastic body, which forces the elastic body to yield laterally. In this instance, the narrowest place is located shortly before or above the hollow space, which is a recess for the head of the projections entering its engaging position.

In both cases, as the projections enter their position of engagement, the elastic body tends to yield to the radial force in the there-located hollow space, i.e., enter the radial recess, if need be.

Figure 5:
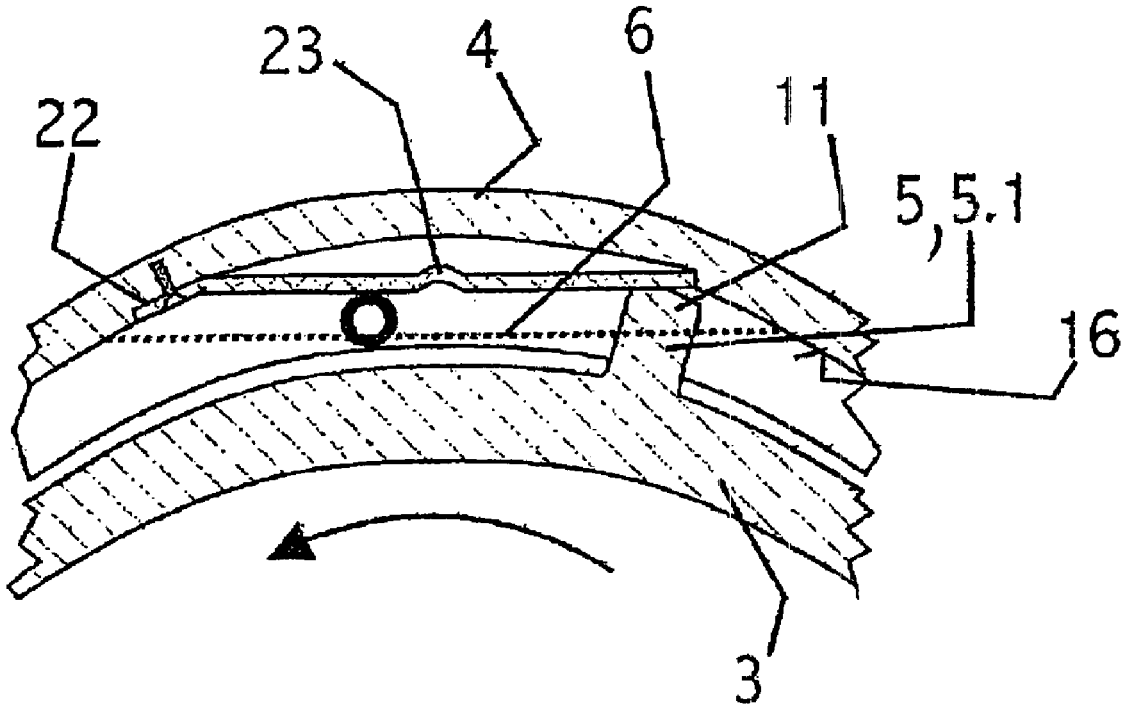
FIG. 5 is a partial sectional view of an embodiment with a flexible tongue.
Figure 7:
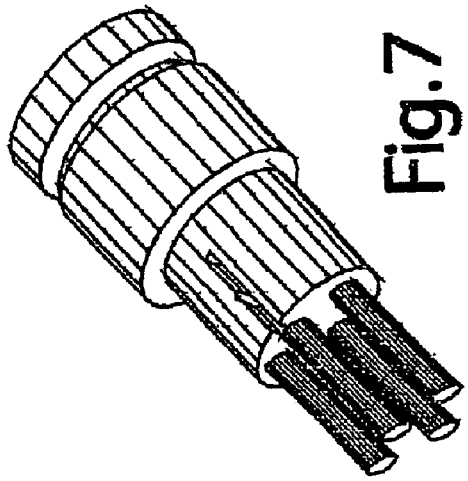
FIG. 7 is a perspective view of a plug-in contact part with a connection element for the grounding contact.

In the embodiment of FIG. 5, the outer ring 4 has a circular-cylindrical track 16, along which the heads 11 of the projections 5 slide with a play. In the position of engagement, a flexible tongue 10 extends, which has with its center region no contact with the bottom and extends thereover while forming a hollow space. The flexible tongue may be made of an elastic plastic or metal. It is bent on its one side and mounted with this bent tab in a pocket 22. In the track 16, this pocket is formed such that the tab disappears therein, and is unable to come into contact with a projection moving thereover. As an alternative, it is formed beyond the engagement position, where it is unable to come into contact with the projections. In its center region, the flexible tongue is provided with a notch 23, which extends radially outward, and is adapted to the head of the projection. In this notch, the head will be clamped in the circumferential direction as it enters its position of engagement.

In the rotated position, in which the polygonal disk 5 fits through the polygonal opening 6, it is possible to insert the two tube ends into each other, so that the outer ring 4 extends beyond the inner ring 3. In this case, the bottom 16 of groove 8 constitutes with the elastic body, ring, spring ring, or O-ring located therein the radial track for the projections 5.1 et seq. Consequently, it is dimensioned such that the heads 11 of the projections 5.1, 5.2 . . . are able to push the ring 3 and the elastic body without exerting special forces radially outward to such an extent that the projections 5 and the elastic body or ring lie in the same axial plane as this elastic body. In the present application, this rotated position is named inserting position. In this axial relative position, it is possible to rotate the tube ends relative to each other. As a result, the projections 5 slide with their heads 11 in the track 16 in such a manner that they push the elastic body outward, however, without interfering with the rotational movement. By the relative position of the tube ends, the projections 5.1, 5.2 . . . enter their—in this Application so-called—engaging position. In their engaged position, the projections 5.1, 5.2 of the inner ring are covered by the projections 6.1, 6.2 . . . of the outer ring, so that an axial connection results. In this connection, it is also known that by narrowing the gap between the projections 6.1, 6.2 and the front wall 15 of the outer ring, it is possible to clamp the projections 5.1, 5.2 . . . of the inner ring somewhat in the axial direction, so that the two tube ends are locked in position.

In the embodiment with an independently rotatable bayonet ring, the stop ring 13 and the end face of the bayonet ring on the one hand, as well as the end face of the other tube end 1 or the polygonal disk 5 attached thereto, are so dimensioned that by closing is the bayonet joint the end face of tube end 2 comes into close contact with the polygonal disk on tube end 1, and that the gasket 21 seals the butt seam between the end faces of tube end 2 and the polygonal disk.

The embodiment of FIG. 4 does not require a relative movement of the tube ends in the circumferential direction. Instead, it is possible to rotate the outer ring 4 separately, so as to result in a close connection of the two tube ends. In particular in this connection, it is also possible to insert the gasket 21—as described—into the separate end face 17, which is permanently joined to the tube end 2, and to cause it to seal relative to the end face of the other tube end 1, without the gasket and the opposite face having to perform a relative movement in the circumferential direction.

The engaging position is located in the region of the greatest overlap of the projections 5 and 6. This engaging position can be defined by a stop pin 18 for one of the projections 5.1–5.4. The stop pin 18 is shown in FIG. 3. It extends over the groove 8, which is formed between the face end 15 and the projections 6 of outer ring 4 in the axial direction, and it extends in the rotational direction directly behind the engaging position, so that a further relative movement is no longer possible.

In this engaging position, the heads 11 of projections 5.1–5.4 push the ring 10 into the recess 9 of groove bottom 8, which is arranged in the region of the engaging position. To this end, it is necessary to dimension the groove bottom plus the thickness of the ring such that before entering into the engaging position, the heads 11 of the projections 5.1, 5.2 . . . exert a radial force on the ring.

The arrangement of the recess in the region of the engaging position causes the elastic ring to yield in the region of the recess to the radial force of the projections 5.1, 5.2 . . . , to constitute thereby relative to the sides of the recess, an impediment to the rotational movement in the circumferential direction, and furthermore, however, to exert also a rotationally symmetric radial force on the inner ring. As a result, the two tube ends 1 and 2 are centered relative to each other. Furthermore, the bayonet joint is secured against unintentional rotation. To release the bayonet joint, it is necessary to overcome the locking force, which the ring exerts on the projections 5.1. In FIG. 5, the projection 6 of the outer bayonet ring 4 is not shown, but indicated in phantom lines in the form of a side wall.

It should be noted that the tube connection by the bayonet joint, in particular by some of the bayonet joints of the present invention, is suitable for all types of tubes, for example, also for water and gas pipes. Consequently, the scope of the present invention is not limited to electrical couplings.

What is claimed is:

1. A coupling for providing an explosion-proof connection between electric line ends, comprising:

tubes, wherein the line ends are respectively accommodated in and permanently connected to the tubes, the line ends include plug-in contact parts with contact elements, the contact elements include a contact pin of one of the plug-in contact parts and a contact socket of another of the plug-in contact parts, and the contact pin is for being plugged into the contact socket to provide a conductive connection between the contact elements, a bayonet joint for coupling the tubes to one another in an explosion-proof manner, wherein the contact elements are positioned so that the conductive connection exists while the tubes are coupled to one another in the explosion-proof manner, and the bayonet joint includes:

radially outward directed projections carried by an inner tube of the tubes, radially inward directed projections carried by an outer tube of the tubes, a track of the outer tube that is for simultaneously being in receipt of the outward directed projections and allowing relative movement between the outward directed projections and the inward directed projections between:

an engaging position in which the outward directed projections and the inward directed projections respectively interact with one another in a manner that restricts the inner tube from being withdrawn from the outer tube, with the outward directed projections and the inward directed projections being in the engaging position while the tubes are coupled to one another in the explosion-proof manner, and an inserting position in which the outward directed projections and the inward directed projections are not arranged with respect to one another in said manner that restricts the inner tube from being withdrawn from the outer tube, a recess adjacent and positioned radially outward of the track, and an elastic body that is adjacent the recess, wherein the track, the outward directed projections and the elastic body are sized and adapted with respect to one another:

so as not to impede the inner tube and the outward directed projections from being axially inserted into the outer tube during the inserting position, and so that the elastic body is forced into the recess by an outwardly directed projection of the outwardly directed projections while the outwardly directed projections of the inner tube enter the engaging position.

2. The coupling of claim 1, wherein:

for each of the plug-in contact parts, the plug-in contact part includes a radial projection, which functions as a stop that cooperates with a corresponding projection, in the tube in which the plug-in contact part is accommodated, and the projections axially secure the plug-in contact part in the respective tube to restrict movement of the plug-in contact part in a forward direction which extends from the plug-in contact part toward the other plug-in contact part while the tubes are coupled to one another in the explosion-proof manner;

for each of the tubes, the tube's end into which the respective line ends enter the tube is closed by an insulating end cap, which sealingly surrounds the electric lines that enter the tube;

the outer tube, in which the respective plug-in contact part with contact pins is axially secured, projects beyond tips of the contact pins secured within the outer tube and comprises an enlarged inside diameter, that surrounds the inner tube with a narrow cylindrical gap that is sealed; and for each of the tubes, a hollow space between the plug-in contact part within the tube, and the outlet of the end cap that closes the tube contains a stop packing, and the stop packing is supported in the region of the end cap and presses the plug-in contact part that is within the tube in the forward direction.

3. The coupling of claim 2, wherein for each of the tubes, the stop packing comprises a thermosetting, electrically nonconducting synthetic resin, that encapsulates the hollow space.

4. The coupling of claim 3, wherein for each of the tubes, the respective line end is axially secured in the tube by circumferential bead arranged on the end cap.

5. The coupling of claim 2, wherein for each of the tubes, the stop packing comprises an elastic ring, which is supported in the region of the end cap.

6. The coupling of claim 5, wherein for each of the tubes, the elastic ring is supported in the region of the end cap on a support ring that includes an external thread by way of which the support ring is screwed into the tube.

7. The coupling of claim 2, wherein for each of the plug-in contact parts, the radial projection is a diametrical step, and the diametrical step functions as a stop that cooperates with a corresponding projection of the tube in which the plug-in contact part is accommodated to axially secure the plug-in contact part in the respective tube to restrict movement of the plug-in contact part in the forward direction.

8. The coupling of claim 2, wherein for each of the tubes, the end cap is a screw-on type end cap which includes a bending bead, and the bending bead sealingly surrounds the electric lines that enter the tube.

9. The coupling of claim 1, wherein the plug-in contact part and the contact elements mounted within the inner tube are made substantially identical to the plug-in contact part and the contact elements mounted within the outer tube with respect to axial and radial retention.

10. The coupling of claim 1, wherein the radially outward directed projections carried by the inner tube are formed on a circular-cylindrical bayonet ring, which is rotatably supported as an independent annular component on the inner tube for moving between the inserting position and the engaging position the bayonet ring is axially secured by contacting a diametrical step, the bayonet ring extends into a radially extending annular gap that is formed between a free end of the outer tube and the inner tube's circumference, and the bayonet ring extends axially from proximate the outer tube's end face.

11. The coupling of claim 10, wherein the radial projections of the inner ring are corners of a disk, and the disk is arranged on the bayonet ring's end face.

12. The coupling of claim 11, wherein the disk is a regular polygonal disk, and the polygonal disk's periphery extends substantially around the inner tube.

13. The coupling of claim 1, wherein the engaging position of the bayonet joint is unilaterally defined by a stop, which is proximate at least one of the projection's travel path, with the travel path extending between the inserting position and the engaging position of the at least one of the projections.

14. The coupling of claim 1, wherein:

the recess that is adjacent and positioned radially outward of the track is one of a plurality of recesses that are adjacent and positioned radially outward of the track, and the elastic body is respectively forced into the recesses by the outwardly directed projections during the engaging position.

15. The coupling of claim 1, wherein the track is annular and the elastic body is positioned substantially free of play in the annular track.

16. The coupling of claim 1, wherein the elastic body is selected from the group consisting of an elastic ring, a rubber ring, and a helical spring ring.

17. The coupling of claim 1 wherein:

each of the plug-in contact parts includes a cylindrical plastic drum with axial bores which are arranged in a bore pattern, the bore pattern of the plastic drum of a first of the line ends is identical to the bore pattern of the plastic drum of a second of the line ends, for each of the bores of each of the plastic drums:

the bore is adapted to the outside diameter of the contact element that is received by the bore so that the contact element that is received by the bore can be inserted into the bore at the plastic drum's end which faces away from the other plastic drum while the tubes are coupled to one another in the explosion-proof manner, and the bore includes a radial necking that is proximate the plastic drum's end which faces toward the other plastic drum while the tubes are coupled to one another in the explosion-proof manner, the radial necking functions as an axial stop for the contact element that is received by the bore, the necking leaves a passage only for a front end of the contact element that is received by the bore, and the front end of the contact element that is received by the bore is thinner than a rear end of the contact element that is received by the bore, and for each of the plastic drums, the plastic drum includes a circumferential groove which extends into the bores of the plastic drum, and a snap ring is inserted into the circumferential groove so that the snap ring extends into the bores of the plastic drum and engages behind necking of the contact elements respectively within the bores of the plastic drum for axially locking the contact elements respectively within the bores of the plastic drum.

* * * * *